US009196195B2

(12) United States Patent
Tamura et al.

(10) Patent No.: US 9,196,195 B2
(45) Date of Patent: Nov. 24, 2015

(54) DISPLAY APPARATUS AND ELECTRONIC EQUIPMENT

(71) Applicant: SEIKO EPSON CORPORATION, Tokyo (JP)

(72) Inventors: Tsuyoshi Tamura, Suwagun-Haramura (JP); Takeshi Nomura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 31 days.

(21) Appl. No.: 14/175,512

(22) Filed: Feb. 7, 2014

(65) Prior Publication Data

US 2014/0285411 A1 Sep. 25, 2014

(30) Foreign Application Priority Data

Mar. 22, 2013 (JP) ..... 2013-060194

(51) Int. Cl.
*G09G 3/32* (2006.01)

(52) U.S. Cl.
CPC ..... *G09G 3/3208* (2013.01); *G09G 2300/0861* (2013.01); *G09G 2310/0248* (2013.01); *G09G 2310/0289* (2013.01); *G09G 2310/0297* (2013.01); *G09G 2320/0209* (2013.01)

(58) Field of Classification Search
None
See application file for complete search history.

(56) References Cited

U.S. PATENT DOCUMENTS

| | | | | |
|---|---|---|---|---|
| 2007/0029644 | A1 | 2/2007 | Nakagawa | |
| 2007/0242002 | A1 * | 10/2007 | Kawabe | 345/76 |
| 2011/0050741 | A1 * | 3/2011 | Jeong | 345/690 |
| 2012/0229438 | A1 * | 9/2012 | Fujita | 345/211 |
| 2013/0093653 | A1 | 4/2013 | Ota et al. | |

FOREIGN PATENT DOCUMENTS

| | | |
|---|---|---|
| JP | A-06-011684 | 1/1994 |
| JP | A-2006-119404 | 5/2006 |
| JP | A-2007-041265 | 2/2007 |
| JP | A-2012-189828 | 10/2012 |
| JP | A-2013-088610 | 5/2013 |

* cited by examiner

*Primary Examiner* — Jason Olson
*Assistant Examiner* — Krishna Neupane
(74) *Attorney, Agent, or Firm* — Oliff PLC

(57) ABSTRACT

A plurality of pixel circuits provided in a display apparatus respectively include light-emitting elements OLED, first transistors that supply driving currents to the light-emitting elements, second transistors that turn on and off connection between data lines and gates of the first transistors, and third transistors. The display apparatus has first holding capacitors that are respectively inserted and connected midway on the plurality of data lines and shift levels of driving voltages of the first transistors, and holding capacitors that respectively hold potentials of the plurality of data lines. N first holding capacitors are arranged in a column direction Y, each of the first holding capacitors having an electrode width that is smaller than a width of N pixel circuits arranged adjacent to each other in a row direction X, and that is equal to or larger than a width of one pixel circuit.

20 Claims, 11 Drawing Sheets

DISPLAY APPARATUS AND ELECTRONIC EQUIPMENT

CROSS-REFERENCE TO RELATED APPLICATIONS

This application claims priority to Japanese Patent Application No. 2013-060194 filed on Mar. 22, 2013. The entire disclosure of Japanese Patent Application No. 2013-060194 is hereby incorporated herein by reference.

BACKGROUND

1. Technical Field

The present invention relates to a display apparatus, electronic equipment, and the like.

2. Related Art

Display apparatuses using light-emitting elements such as organic light-emitting diode (OLED) elements have a problem in which a change in signals in a data line adversely affects a pixel transistor, which leads to vertical crosstalk. In the related art, a shield line is provided between a data line and a pixel transistor inside a pixel (JP-A-2012-189828).

It was confirmed that the amplitude in the signal line at a drain contact portion of a pixel transistor actually affects the gate holding voltage at the drive transistor, which leads to vertical crosstalk.

In order to prevent vertical crosstalk, an attempt has been made to perform driving while reducing the voltage amplitude in the data line, and examples of the method therefor include the capacitance dividing method. However, it is not easy to form a holding capacitor having a predetermined area for each data line.

In recent years, for example, a driver including a latch circuit can be installed in a display panel such as an LCOS panel or an Si-OLED (organic light-emitting diode) panel in which a liquid crystal layer is formed on a silicon substrate. In this case, the latch circuit is formed in consideration of a pixel pitch of display pixels formed in the display panel. The reason for this is to make it easy to establish interconnection, by arranging a latch element for latching data that is to be supplied to one pixel, within the width of that pixel.

However, for example, in the case of a micro display panel used for a display such as an electronic viewfinder (EVF) or a head-mounted display (HMD), the pixel pitch is as small as, for example, 2.5 μm. Accordingly, it is actually impossible to provide holding capacitors on the data lines within the range of the pixel pitch.

SUMMARY

An advantage of some aspects of the invention is to provide a display apparatus and electronic equipment in which, even in the case of a display apparatus having a small pixel pitch, holding capacitors connected to data lines can be sufficiently ensured, so that the amplitude in the data lines can be compressed and vertical crosstalk can be reduced.

(1) An aspect of the invention is directed to a display apparatus, including:

a plurality of pixel circuits that are arranged in a row direction in a display panel and respectively connected to a plurality of data lines extending in a column direction;

light-emitting elements that are respectively arranged in the plurality of pixel circuits;

first transistors that are respectively arranged in the plurality of pixel circuits, and supply driving currents to the light-emitting elements;

second transistors that are respectively arranged in the plurality of pixel circuits, and turn on and off connection between the data lines and the gates of the first transistors;

third transistors that are respectively arranged in the plurality of pixel circuits, and turn on and off connection between the gates and drains of the first transistors;

first holding capacitors that are respectively inserted and connected midway on the plurality of data lines, and shift levels of driving voltages of the first transistors; and holding capacitors that respectively hold potentials of the plurality of data lines;

wherein N first holding capacitors (N is a plural number) are arranged in the column direction, each of the first holding capacitors having an electrode width that is smaller than a total width of N pixel circuits arranged adjacent to each other in the row direction, and that is equal to or larger than a width of one pixel circuit.

With this aspect of the invention, the second and the third transistors are provided in addition to the first transistor. Thus, capacitance dividing drive is possible in which a voltage of the data line set to an initialization voltage in an initialization period (the second and the third transistors are off) is changed to a voltage corresponding to the threshold voltage of the first transistor in a compensation period (the second and the third transistors are on), and is further changed to a voltage obtained by shifting by a value obtained by dividing a change in the potential of the first holding capacitor by a capacitance ratio between the holding capacitor and the first holding capacitor in a write period (the second transistor is on, and the third transistor is off). The N first holding capacitors each having an electrode width that is smaller than the total width of the N pixel circuits and that is equal to or larger than the width of one pixel circuit have an increased width but can have an accordingly reduced length in the column direction. Thus, sufficient capacitance can be ensured with a realistic size. Especially when a first holding capacitor is disposed within the width of one pixel circuit, the area occupied by margins of the capacitors adjacent to each other in the row direction increases in order to form the first holding capacitor, and the electrode width of the first holding capacitor can hardly be ensured. This problem is solved by an aspect of the invention in which the electrode width of the first holding capacitor is set to be smaller than the total width of the N pixel circuits and to be equal to or larger than the width of one pixel.

(2) In this case, it is preferable that gradation voltages are simultaneously written to the N first holding capacitors via N data lines that are connected to the N first holding capacitors.

Writing of gradation voltages to the N first holding capacitors at different timings may cause crosstalk. That is to say, a gradation voltage written to one of the N first holding capacitors at a certain timing adversely affects voltages of the data lines connected to the other first holding capacitors to which gradation voltages have been already written. If the writing is limited to simultaneous writing, such a problem hardly occurs.

(3) In this case, it is preferable that the gradation voltages simultaneously written are subpixel data signals forming one dot of a color display.

Typically, voltages are written to RGB pixels forming one dot of a color display at different timings. However, with this aspect of the invention, the simultaneous writing makes it possible to reduce crosstalk due to capacitive coupling.

(4) In this case, it is preferable that the N data lines are arranged in the lower layer of the N first holding capacitors.

Since the simultaneous writing solves the problem of capacitive coupling, N data lines can be arranged in the lower layer of the N first holding capacitors. Accordingly, a space-saving design is realized.

(5) In this case, it is preferable that shield lines having fixed potentials are arranged on both sides of each of the N data lines in the lower layer of the N first holding capacitors, when viewed from above.

Accordingly, the N data lines can be shielded from external noise.

(6) In this case, it is preferable that a shield line having a fixed potential is disposed between two groups of the N first holding capacitors that are adjacent to each other in the row direction.

Since voltages are not absolutely simultaneously written to two groups of the N first holding capacitors that are adjacent to each other in the row direction, and, thus, crosstalk can be prevented by isolation using the shield lines.

(7) In this case, it is preferable that the display apparatus further includes second holding capacitors that are connected via transfer gates to the first holding capacitors, and N second holding capacitors are arranged in the column direction, each of the second holding capacitors having an electrode width that is smaller than a total width of the N pixel circuits, and that is equal to or larger than a width of one pixel circuit.

Since the transfer gate and the second holding capacitor are further provided, a gradation voltage can be supplied to and temporarily held by the second holding capacitor before the write period (the period including the initialization period and the compensation period). In the write period, when the transfer gate is turned on, the potential of the electrode of the first holding capacitor can be changed. The second holding capacitor also can have an electrode width that is smaller than the total width of the N pixel circuits and that is equal to or larger than the width of one pixel circuit. Accordingly, sufficient capacitance of the second holding capacitor can be ensured with a realistic size, as in the case of the first holding capacitor.

(8) In this case, it is preferable that initialization switches for supplying initialization potentials to both electrodes of the first holding capacitors, control signal lines for controlling the initialization switches, and buffers arranged midway on the control signal lines are arranged in the lower layer of the N second holding capacitors.

With this aspect of the invention, interconnects and constituent components necessary for driving the first and the second holding capacitors and the data lines are arranged in the lower layer of the N second holding capacitors. Thus, the space can be saved.

(9) In this case, it is preferable that the buffers include a first stage buffer, a second stage buffer, and a third stage buffer, and the control signal lines include:

a first control signal line that extends in the row direction from the first stage buffer disposed on one side in the row direction to the lower layer of the N second holding capacitors;

a second control signal line that is connected via the second stage buffer to the first control signal line and extends from both ends in the row direction in the lower layer of the N second holding capacitors;

third control signal lines that extend in the column direction from the second control signal line outside the lower layer of the N second holding capacitors; and fourth control signal lines that extend in the row direction from the third control signal lines in the lower layer of the N second holding capacitors;

wherein the third stage buffer is connected to the fourth control signal lines.

Since the buffers are configured as having a plurality of stages, the number of control signal lines that extend in the column direction in the lower layer of the second holding capacitors can be reduced to the extent possible, and, thus, a change in the potential of the data lines is suppressed.

(10) In this case, it is preferable that the second holding capacitor is formed by stacking a plurality of capacitor elements in a height direction.

Since a plurality of capacitor elements are stacked in a height direction, the area occupied by the holding capacitors for ensuring a predetermined capacitance value is reduced, and the space can be saved.

(11) Another aspect of the invention is directed to an electronic equipment including the display apparatus according to any one of the above-described aspects. Examples of the electronic equipment include an electronic viewfinder (EVF) and a head-mounted display (HMD).

BRIEF DESCRIPTION OF THE DRAWINGS

The invention will be described with reference to the accompanying drawings, wherein like numbers reference like elements.

DESCRIPTION OF EXEMPLARY EMBODIMENT

The following describes in detail a preferred embodiment of the invention. The embodiment set forth herein is not intended to unduly limit the scope of the invention defined in the claims, and not all of the structural features described in the embodiment are essential to the solution of the invention.

1. Display Apparatus (Electro-Optical Apparatus)

Figure 1:
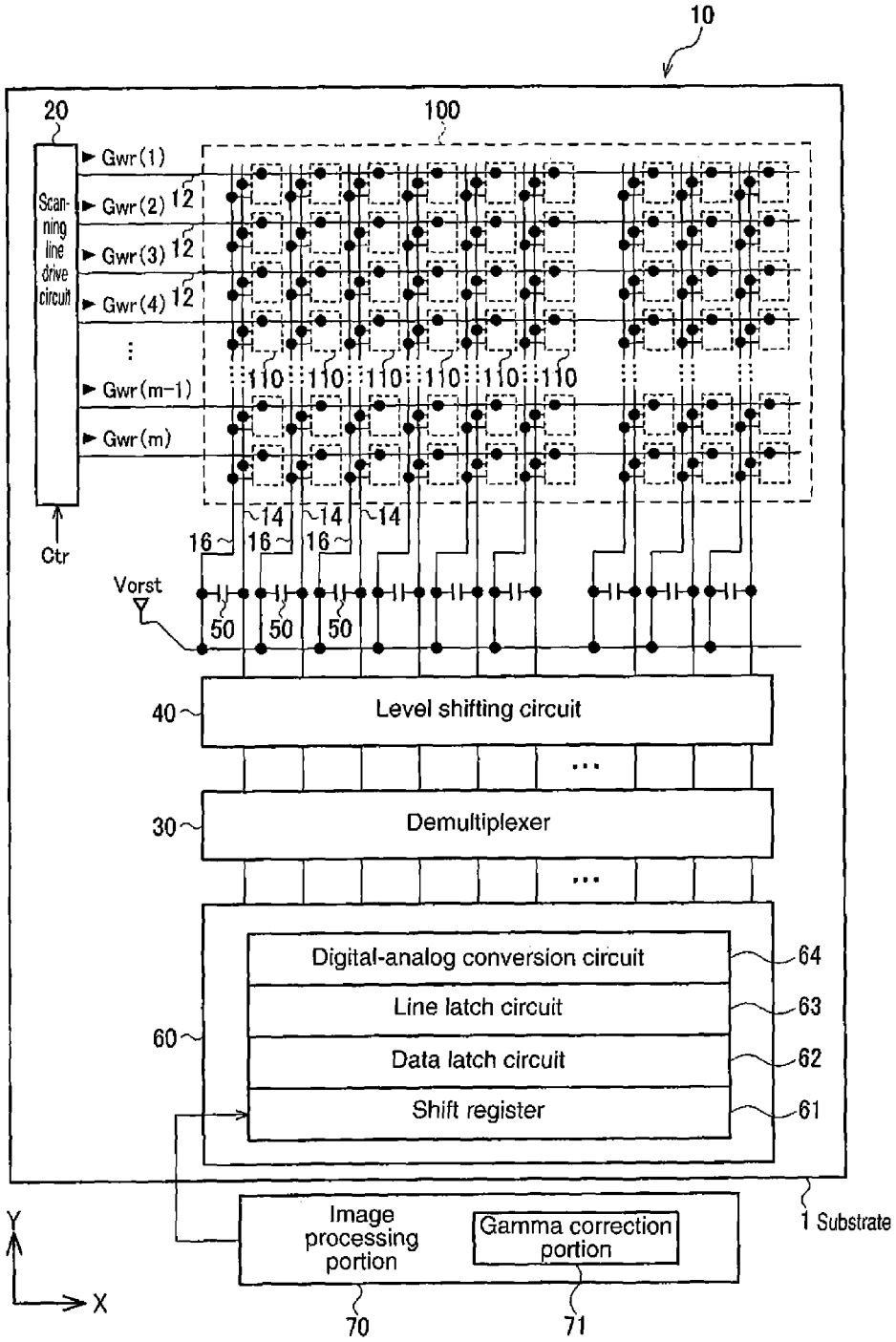
FIG. 1 is a diagram showing an example of a display apparatus of the invention.

FIG. 1 shows a display apparatus (electro-optical apparatus) 10 of this embodiment. The display apparatus 10 is configured such that a scanning line drive circuit 20, a demultiplexer 30, a level shifting circuit 40, a data line drive circuit 60, and a display portion 100 are formed on a semiconductor substrate such as a silicon substrate 1.

In the display portion 100, a plurality of scanning lines 12 are arranged in a row direction (horizontal direction), and a plurality of data lines 14 are arranged in a column direction (vertical direction) Y. A plurality of pixel circuits 110 each connected to one of the scanning lines 12 and one of the data lines 14 are arranged in a matrix.

In this embodiment, three pixel circuits 110 successively arranged along one scanning line 12 respectively correspond to R (red), G (green), and B (blue) pixels, and these 3 pixels represent one dot of a color image.

Figure 2:
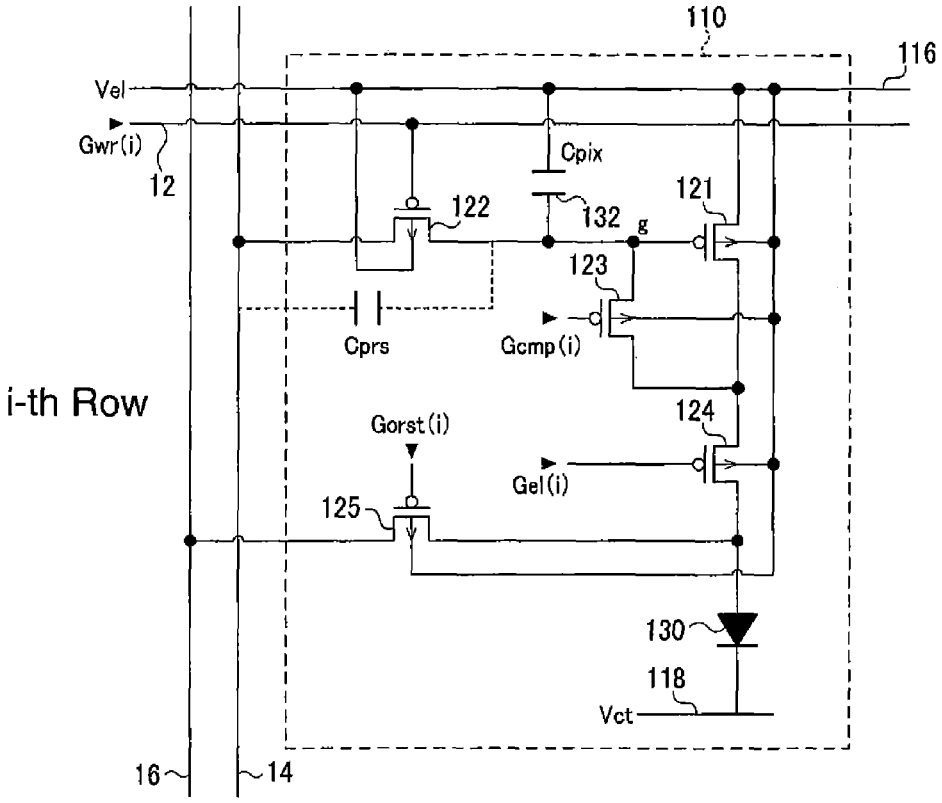
FIG. 2 is a circuit diagram of the pixel circuit shown in FIG. 1.

Hereinafter, an example of the pixel circuits 110 will be described. As shown in FIG. 2, the pixel circuit 110 in an i-th row includes P-type transistors 121 to 125, an OLED 130, and a holding capacitor 132. A scanning signal Gwr(i) and control signals Gel(i), Gcmp(i), and Gorst(i) are supplied to the pixel circuit 110.

The drive transistor (first transistor) 121 has a source that is connected to a feeder line 116 and a drain that is connected via the transistor 124 to the OLED 130, and controls a current to the OLED 130. The second transistor 122 for writing a data line potential (gradation potential) has a gate that is connected to the scanning line 12, and a drain and a source one of which is connected to the data line 14 and the other of which is connected to the gate of the first transistor 121. The holding capacitor 132 is connected between the gate line of the first transistor 121 and the feeder line 116, and holds the voltage between the source and the gate of the first transistor 121. A high potential Vel of the power source is fed to the feeder line 116. The cathode of the OLED 130 is used as a common electrode, and is set to a low potential Vct of the power source.

The third transistor 123 has a gate that receives input of the control signal Gcmp(i), and causes a short-circuit between the gate and the drain of the first transistor 121 in response to the control signal Gcmp(i), thereby compensating for a variation in the threshold of the first transistor 121. The light-emitting control transistor 124 of the OLED 130 has a gate that receives input of the control signal Gel(i), and turns on and off connection between the drain of the first transistor 121 and the anode of the OLED 130. The reset transistor 125 has a gate that receives input of the control signal Gorst(i), and supplies a reset potential Vorst, which is a potential of a feeder line 16, to the anode of the OLED 130 in response to the control signal Gorst(i). The difference between the reset potential Vorst and the common potential Vct is set to be lower than the light-emitting threshold of the OLED 130.

The scanning line drive circuit 20 shown in FIG. 1 supplies the scanning signal Gwr(i) to the scanning line 12 in the i-th row. Holding capacitors 50 are formed by arranging a dielectric between each data line 14 and each feeder line 16 extending in the column direction Y in FIG. 1. The level shifting circuit 40 shifts the level of a gradation voltage input from a digital-analog conversion circuit 64 to a gate voltage for driving the transistor 121 in accordance with the data signal (gradation level) supplied via the data line drive circuit 60 and the demultiplexer 30, and supplies the thus obtained voltage to the data line 14. As a method for the level shifting, it is conceivable to adopt the capacitance dividing method using the holding capacitor 50 and a first holding capacitor 44 and a second holding capacitor 41 inside the level shifting circuit 40. The capacitance dividing method will be described later.

Figure 3:
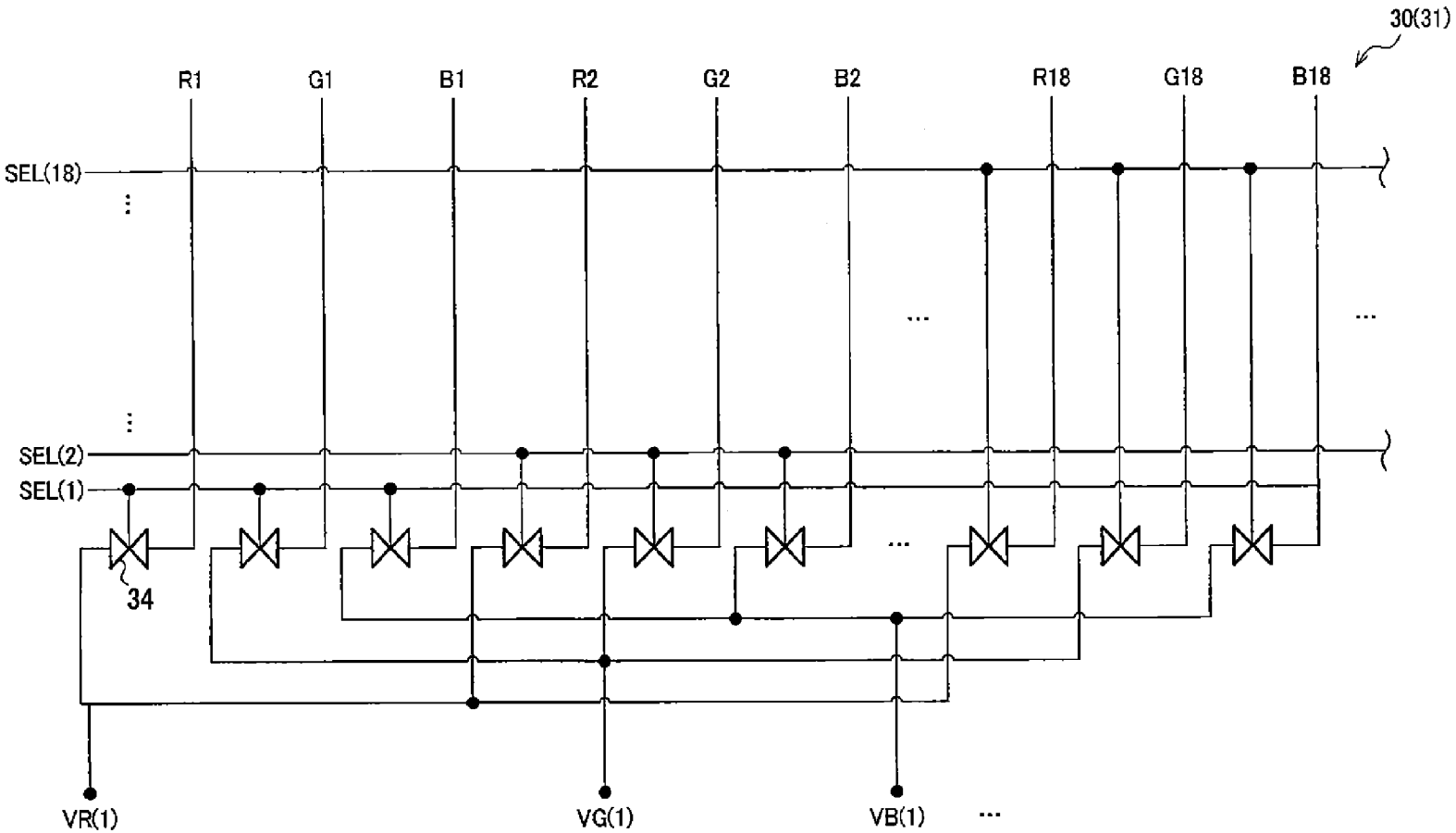
FIG. 3 is a circuit diagram showing part of the demultiplexer circuit shown in FIG. 1.

FIG. 3 shows an example of the demultiplexer 30. FIG. 3 shows a demultiplexer block 31 that switches and outputs the data potential in a time-division manner for each of RGB, to M (e.g., M=18)×3 (RGB) pixels (3×M=54 pixels) on one line (the i-th row) of the display portion 100 in FIG. 1. Demultiplexer blocks 31 as shown in FIG. 3 are provided in the number corresponding to (the total number of pixels in the row direction X)/54. The data potentials for 18 R pixels are input in a time-division manner from the data line drive circuit 60 to an input terminal VR(1) of the demultiplexer 30. In a similar manner, the data potentials for 18 G pixels and 18 B pixels are also input in a time-division manner from the data line drive circuit 60 to input terminals VG(1) and VB(1). Furthermore, 54 switches (transfer gates) 34 are provided between the input terminals VR(1), VG(1), and VB(1) and the 54 data lines. The 54 switches 34 are sequentially turned on three at a time in response to select signals SEL(1) to SEL (18). That is to say, when the select signal SEL(1) is active, the data potentials for 3 pixels (RGB) forming one dot are simultaneously written.

As shown in FIG. 1, functional blocks of the data line drive circuit 60 include a shift register 61, a data latch circuit 62 that sequentially latches data according to a clock from the shift register 61, a line latch circuit 63 that simultaneously latches data from the data latch circuit 62, and a digital-analog conversion circuit 64 that performs digital-analog conversion on data from the line latch circuit 63, and outputs the obtained data as a gradation voltage. The final stage of the digital-analog conversion circuit 64 is provided with an amplifier.

As shown in FIG. 1, the display apparatus 10 may have an image processing portion 70 on or outside the silicon substrate 1. The image processing portion 70 may have a gamma correction portion 71.

2. Capacitance Dividing Method

Figure 4:
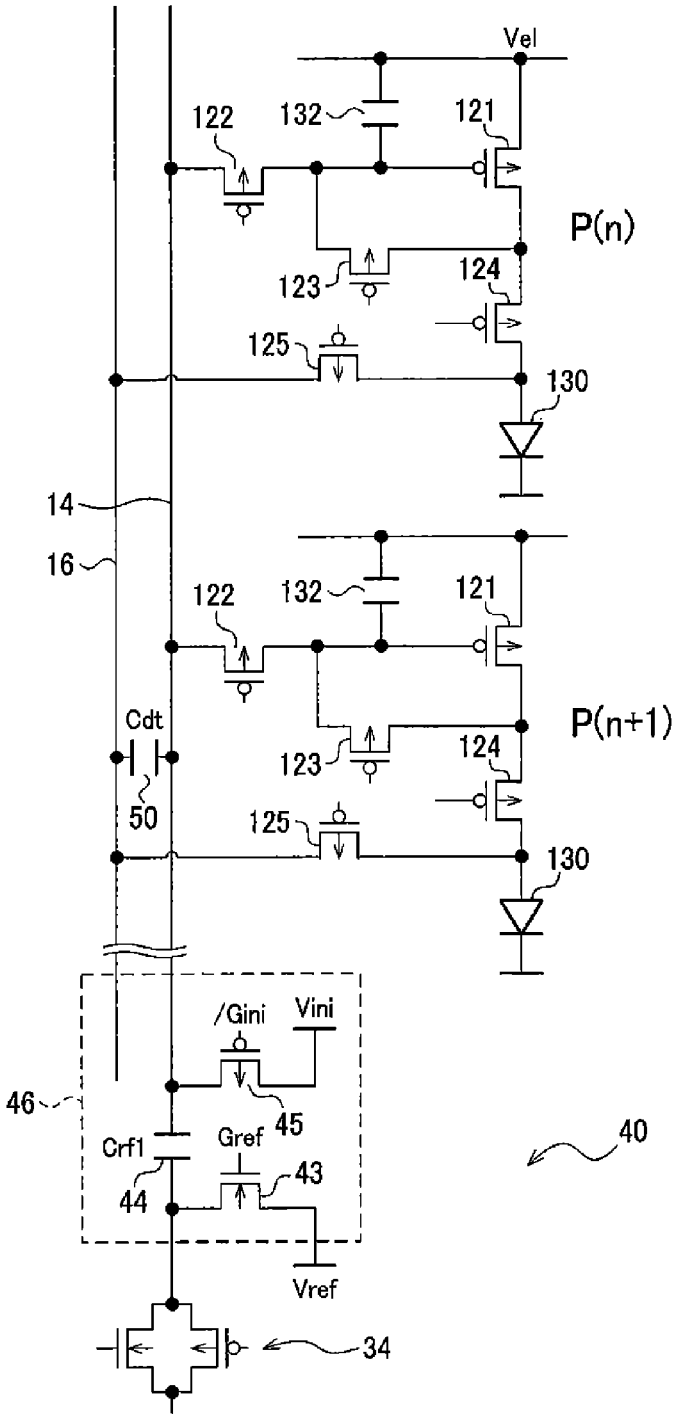
FIG. 4 is a circuit diagram showing part of the level shifting circuit shown in FIG. 1.

FIG. 4 shows a level shifting block 46 for one pixel of the level shifting circuit 40 shown in FIG. 1. The level shifting block 46 shown in FIG. 4 is shown with respect to only one data line 14. The first holding capacitor 44 is connected midway on the data line 14. An initialization switch 45 that sets one end of the first holding capacitor 44 to an initialization potential Vini has a gate that receives supply of a control signal /Gini. An initialization switch 43 that sets the other end of the first holding capacitor 44 to a potential Vref has a gate that receives supply of a control signal Gref. The capacitance dividing method will be described briefly in this specification.

In an initialization period (the transistors 122 and 123 are both off), potentials at both ends of the first holding capacitor 44 are respectively set to potentials Vini and Vref. At that time, the transistor 124 is off, and the transistor 125 is on. In a compensation period (the transistors 122 and 123 are both on) after the initialization period, the transistor 123 is on, and, thus, the transistor 121 forms a diode connection, and the holding capacitor 132 in the pixel circuit 110 holds a threshold voltage Vth of the transistor 121. In a write period (the transistor 122 is on) after the compensation period, the transistor 123 is off, a transfer gate 34 of the demultiplexer 30 is on, and the initialization switch 43 is off. Accordingly, the node at the other end of the first holding capacitor 44 fixed in the initialization period and the compensation period changes from the potential Vref to a gradation level.

The node at one end of the first holding capacitor 44 has a value (Vel−|Vth|+k1·ΔV) obtained by shifting upward, by a value obtained by multiplying a capacitance ratio k1 by a potential change ΔV of that node, from a potential (Vel−|Vth|) in the compensation period. The capacitance ratio k1 is k1=Crf1/(Cdt+Cref1) (where Cdt>Crf1), when the capacitance of the first holding capacitor 44 is taken as Crf1, and the capacitance of the holding capacitors 50 is taken as Cdt. For example, if Crf1:Cdt=1:9, based on a relationship between the potential at the data line 14 and the potential at the gate node of the transistor 121 in the write period, the potential range at the gate node of the transistor 121 is compressed to 1/10 the potential range at the data line 14.

Figure 5:
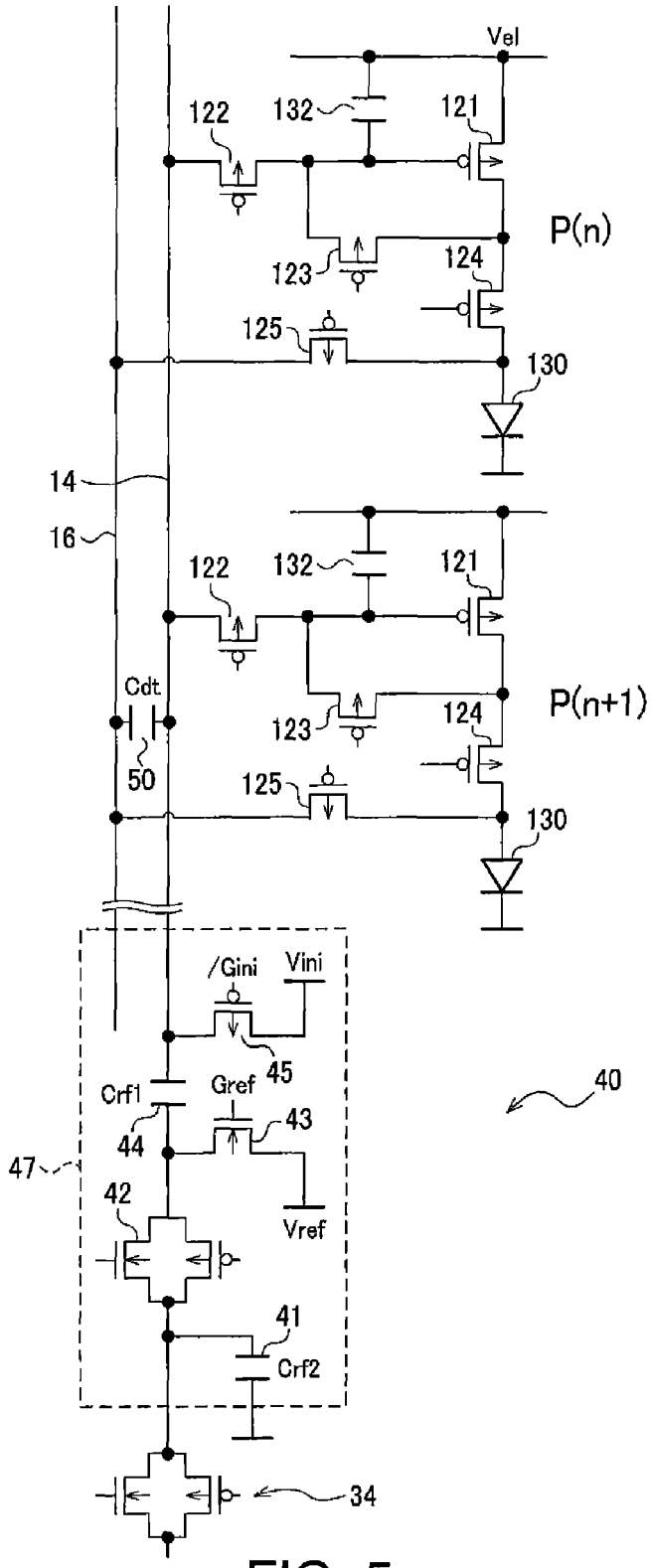
FIG. 5 is a circuit diagram showing part of another level shifting circuit shown in FIG. 1.

As shown in FIG. 5, a level shifting block 47 further including a second holding capacitor 41 and a transfer gate 42 may be provided instead of the level shifting block 46 shown in FIG. 4. With the second holding capacitor 41 and the transfer gate 42, a gradation voltage can be supplied to and temporarily held by the second holding capacitor 41 before the write period (the period in which the transfer gate 42 is off including the initialization period and the compensation period). In the subsequent write period, when the transfer gate 42 is turned on, the potential of the electrode of the first holding capacitor 44 can be changed to match that of the electrode of the second holding capacitor 41. In this case, the capacitance ratio k1 in the above-mentioned formula is changed to a capacitance ratio k2. The capacitance ratio k2 is a capacitance ratio between capacitances Cdt, Crf1, and Crf2 when the capacitance of the second holding capacitor 41 is taken as Crf2.

3. Layout of Holding Capacitor

Figure 6:
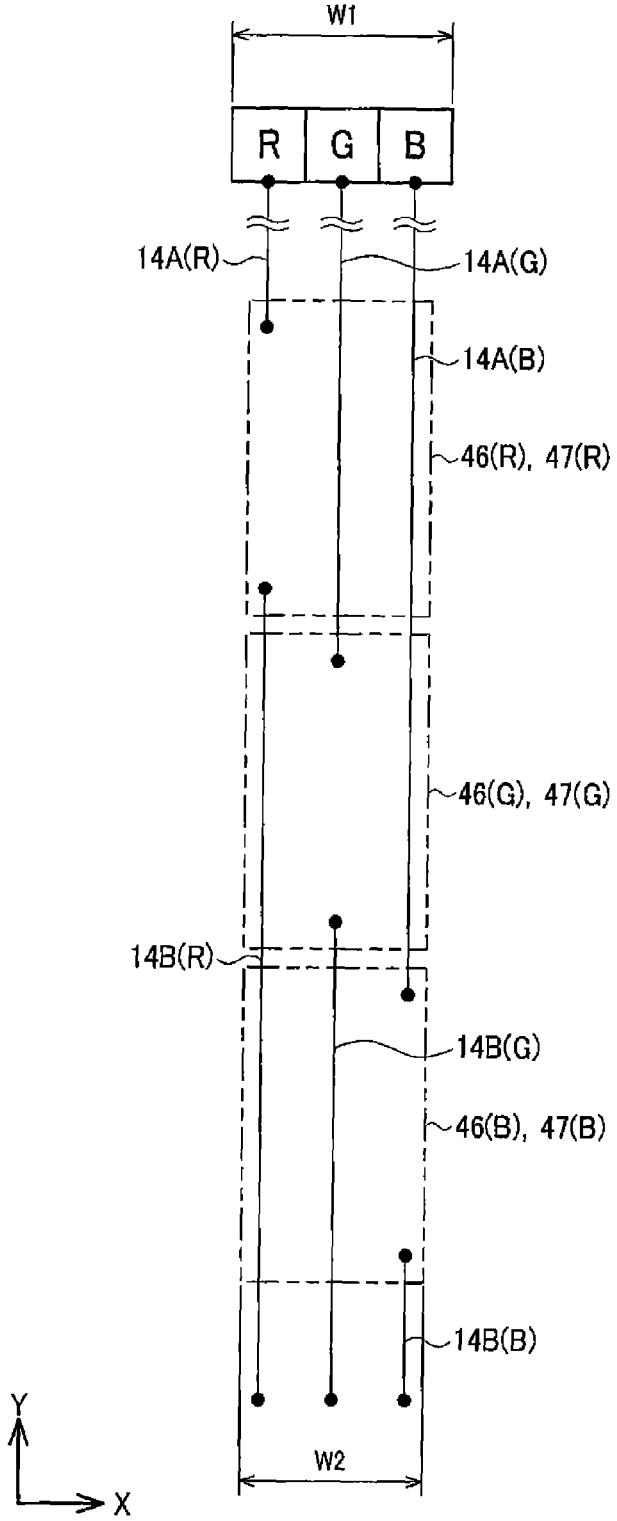
FIG. 6 is a diagram showing a layout of the level shifting blocks shown in FIG. 4 or 5.

FIG. 6 schematically shows the layout of the level shifting blocks 46 shown in FIG. 4 or the level shifting blocks 47 shown in FIG. 5. The level shifting blocks 46(47) corresponding to N pixels (N is a plural number), for example, three pixels that are adjacent to each other in the row direction X are arranged in the column direction Y. In this embodiment, three pixel circuits 110 are RGB pixels forming one color dot. That is to say, three level shifting blocks are configured by a block 46(R) connected to an R pixel, a block 46(G) connected to a G pixel, and a block 46(B) connected to a B pixel. The level shifting block 46(47) has a width W2 that can be $W1/N \leq W2 < W1$ when a total width of the pixel circuits 110 (N=3) is taken as W1. That is to say, the width W2 of the level shifting block 46(47) is smaller than the total width W1 of N pixel circuits 110, and is equal to or larger than the width W1/N of one pixel circuit 110. Note that, in this embodiment, the holding capacitors are made of MIM (metal-insulator-metal).

In the case where the embodiment shown in FIG. 4 is applied to FIG. 6, the level shifting blocks 46(R), 46(G), and 46(B) for an R pixel, a G pixel, and a B pixel are arranged in the column direction Y. In each of the level shifting blocks 46(R), 46(G), and 46(B), the electrode width of the first holding capacitor 44 satisfies the condition of the block width W2. In the case where the embodiment shown in FIG. 5 is applied to FIG. 6, the level shifting blocks 47(R), 47(G), and 47(B) for an R pixel, a G pixel, and a B pixel are arranged in the column direction Y. In each of the level shifting blocks 47(R), 47(G), and 47(B), the first holding capacitor 44 and the second holding capacitor 41 are arranged in the column direction Y, and the electrode widths of the first holding capacitor 44 and the second holding capacitor 41 each satisfy the condition of the block width W2.

Figure 7:
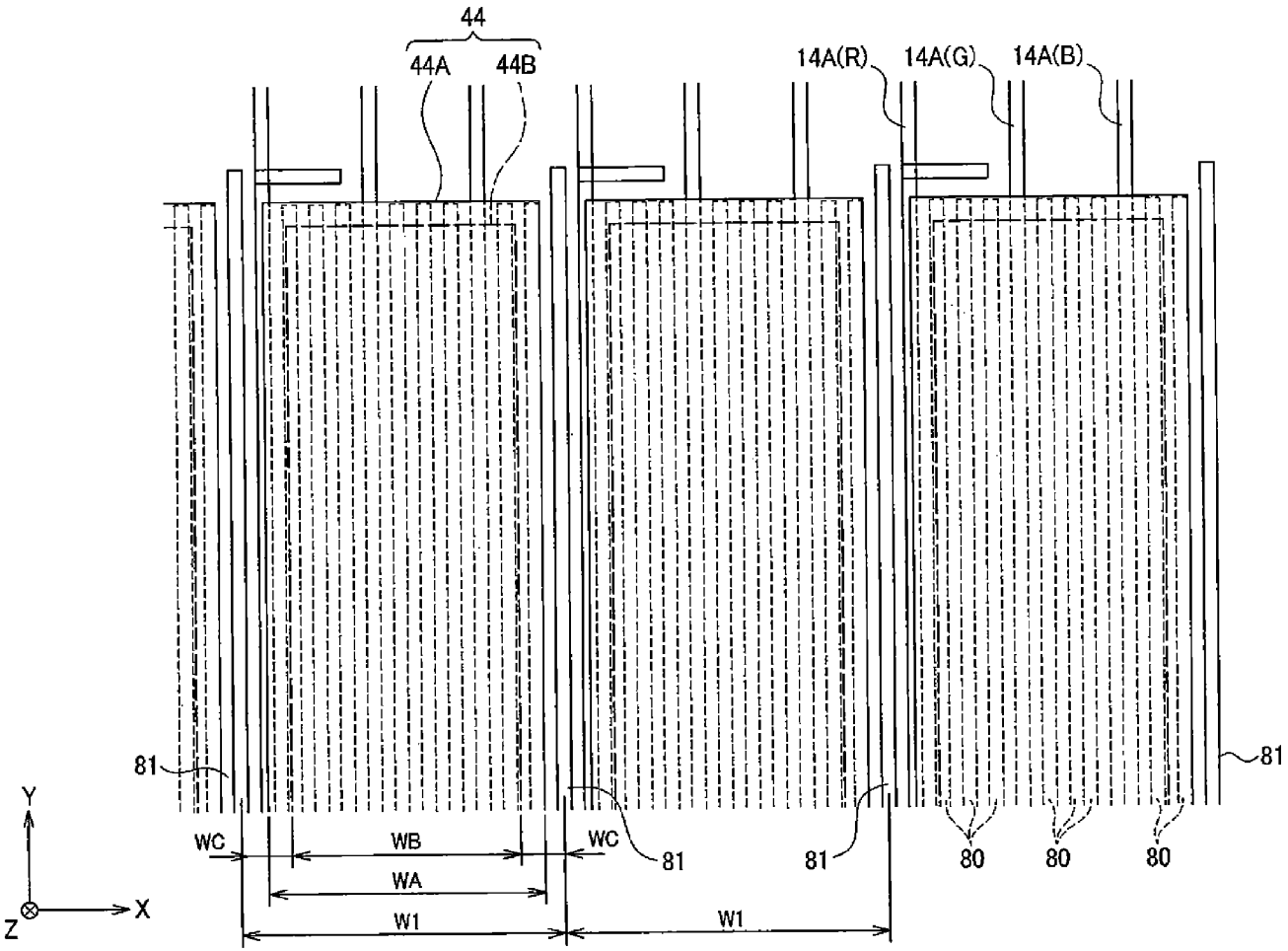
FIG. 7 is a diagram showing shield lines between first holding capacitors and between data lines in the lower layer of the first holding capacitors.

FIG. 7 is a plan view showing the first holding capacitors 44 in the level shifting blocks 46(47) arranged in the X direction at the pitch W1. Data lines 14A(R), 14A(G), and 14A(B) are data lines respectively corresponding to the R, G, and B pixels described in FIG. 1. As shown in FIG. 7, the first holding capacitor 44 has a pair of electrodes 44A and 44B that face each other in a thickness direction Z of the silicon substrate 1. The electrode width of the pair of electrodes 44A and 44B are respectively taken as WA and WB (WA>WB). The portion where the electrodes 44A and 44B face each other forms a capacitor element. Note that $W1/N \leq WA < W1$, and $W1/N \leq WB < W1$.

It is assumed that the total width W1 of three pixel circuits 110 is, for example, 2.5 μm×3=7.5 μm. When the plurality of first holding capacitors 44 are formed at the pitch W1 in the row direction X as shown in FIG. 7, it is necessary to take into consideration the fact that masks used for forming the pair of electrodes 44A and 44B in photolithography processing may be shifted in the X direction. Accordingly, for example, margins WC have to be respectively provided on both sides in the X direction of the electrode 44B. The margin WC only on one side requires a length of 1.1 μm. Thus, the margins WC on both sides require a length of 2.2 μm. In this embodiment, 7.5−2.2=5.3 μm is ensured as the electrode width of the electrode 44B. In this case, the length in the column direction Y is 100 μm in order to ensure a capacitance of 0.5 pF. The electrode width of the second holding capacitor 41 disposed together with the first holding capacitor 44 in the level shifting block 47 is set in a similar manner to the electrode width of the first holding capacitor 44.

If the holding capacitor is disposed within the width of one pixel circuit 110, the electrode width that can be ensured is as small as 2.5−2.2=0.3 μm. In this case, the length in the column direction Y is substantially 1710 μm in order to ensure a capacitance of 0.5 pF. If the first and the second holding capacitors 44 and 41 are arranged, the length in the Y direction is substantially 3420 μm, that is, the chip area increases, and the cost increases, which makes it difficult to realize this structure. In the embodiment shown in FIG. 5, the first holding capacitor 44 and the second holding capacitor 41 each having a length of 100 μm are arranged adjacent to each other in the Y direction in one level shifting block 47, and three blocks for R, G, and B are arranged adjacent to each other in the Y direction, and, thus, the length can be reduced to substantially 100 μm×2×3=600 μm, and the dimensions in the X and Y directions can be balanced.

As shown in FIG. 6, the first holding capacitor 44 in the level shifting block 46(R) or the level shifting block 47(R) is connected via a data line 14A(R) to the R pixel circuit 110, and is connected via a data line 14B(R) to the transfer gate 34 in the demultiplexer 30. The same can be applied to the blocks 46(G), 47(G), 46(B), and 47(B) for the other colors.

RGB gradation voltages are simultaneously written via the data lines 14B(R), 14B(G), and 14B(B) to the first holding capacitors 44 of the three blocks 46(R), 46(G), and 46(B). Alternatively, RGB gradation voltages are simultaneously written via the data lines 14B(R), 14B(G), and 14B(B) to the second holding capacitors 41 of the three blocks 47(R), 47(G), and 47(B). The simultaneous writing makes it possible to ignore noise due to coupling of data interconnects and upper MIM capacitor electrodes.

Furthermore, the data lines 14A(R), 14A(G), 14A(B), 14B(R), 14B(G), and 14B(B) shown in FIG. 6 can be arranged in the lower layer of the three level shifting blocks 46(R), 46(G), and 46(B) or the three level shifting blocks 47(R), 47(G), and 47(B). Accordingly, an extra interconnecting space does not have to be ensured, and, thus, the space can be saved.

In FIG. 7, shield lines 80 or 81 having fixed potentials are arranged on both sides of each of the three data lines 14A(R), 14A(G), and 14A(B) in the lower layer of the MIM holding capacitors, when viewed from above. Accordingly, crosstalk in the X direction is prevented. The shield lines 80 having fixed potentials are shield lines having a high potential level (e.g., VDDH) and a low potential level (e.g., VSS). Furthermore, the shield line 81 having a fixed potential may be disposed between two groups of N holding capacitors 44 (41) that are adjacent to each other in the row direction X. Voltages are not absolutely simultaneously written to two groups of N holding capacitors 44 (41) that are adjacent to each other in the row direction X, and, thus, crosstalk can be effectively prevented.

Figure 8:
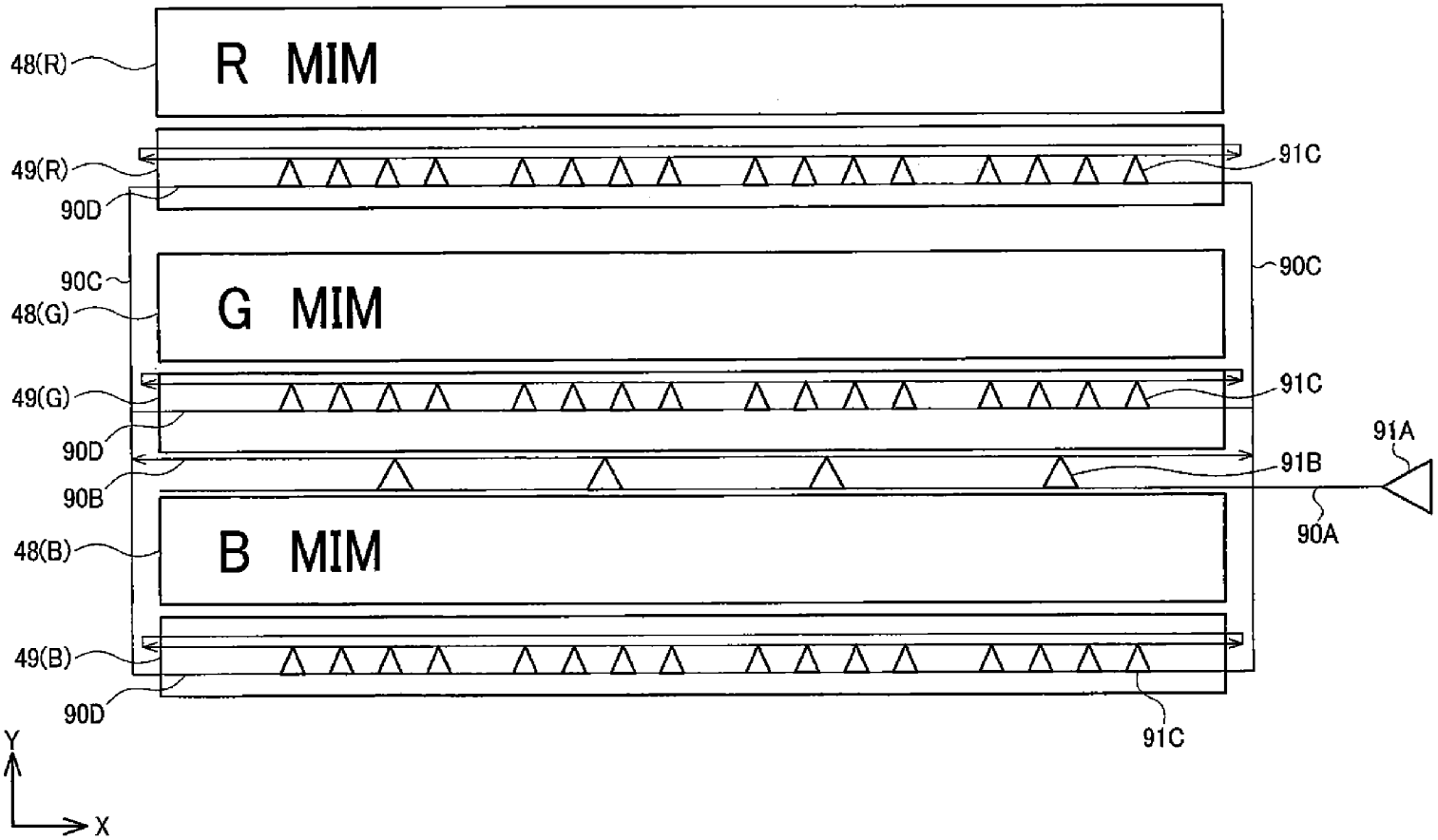
FIG. 8 is a diagram illustrating the arrangement of control signal lines for initialization switches in the lower layer of the second holding capacitors.

FIG. 8 is a schematic plan view of the entire level shifting circuit 40 shown in FIG. 1. As shown in FIG. 8, level shifting regions 48(R) and 49(R) for R are provided along the row direction X. In the level shifting region 48(R), the first holding capacitors 44 shown in FIG. 5 are arranged corresponding to all R pixels. In the level shifting region 49(R), the second holding capacitors 41 shown in FIG. 5 are arranged corresponding to all R pixels. The same can be applied to the level shifting regions 48(G), 49(G), 48(B), and 49(B) for the other colors.

The initialization switches 43 and 45 for supplying a potential to the electrodes of the first holding capacitors 44 shown in FIG. 4 or 5, the /Gini and Gref control signal lines for controlling the initialization switches 43 and 45, and the like can be arranged in the lower layer of the regions 49(R), 49(G), and 49(B) in which the second holding capacitors 41 are formed as shown in FIG. 8.

In FIG. 8, buffers 91 that are arranged midway on control signal lines 90 include a first stage buffer 91A, second stage buffers 91B, and third stage buffers 91C. The control signal lines 90 include a first control signal line 90A that extends in the row direction X from the first stage buffer 91A disposed on one side in the row direction X to the lower layer of the second holding capacitors 41, a second control signal line 90B that is connected via the second stage buffers 91B to the first control signal line 90A and extends in the lower layer of the second holding capacitors 41 so as to project from both ends in the row direction X in the second holding capacitors 41, third control signal lines 90C that extend in the column direction Y outside the region in which the holding capacitors are formed, and a fourth control signal lines 90D that extend in the row direction X from the third control signal lines 90C in the lower layer of the second holding capacitors 41. The third stage buffers 91C are connected to the fourth control signal lines 90D. With this configuration, the control signal lines 90 do not extend in the column direction Y in the region in which the second holding capacitors 41 are formed. Thus, the control signal lines 90 do not adversely affect the first holding capacitors 44. Note that, if lines extending from the buffers 91 or the control signal lines 90 extend in the column direction Y, the above-described shield lines 80 can be arranged on both sides thereof.

Shielding can be provided in a similar manner not only to the buffers 91 and the control signal lines 90 but also to the lines for supplying the initialization potentials Vini and Vref shown in FIG. 4. These lines can be protected by arranging the shield lines on both sides thereof.

Figure 9A:
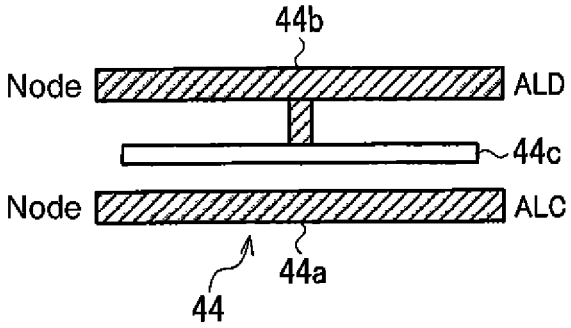
FIGS. 9A and 9B are views showing the first and the second holding capacitors.
Figure 9B:
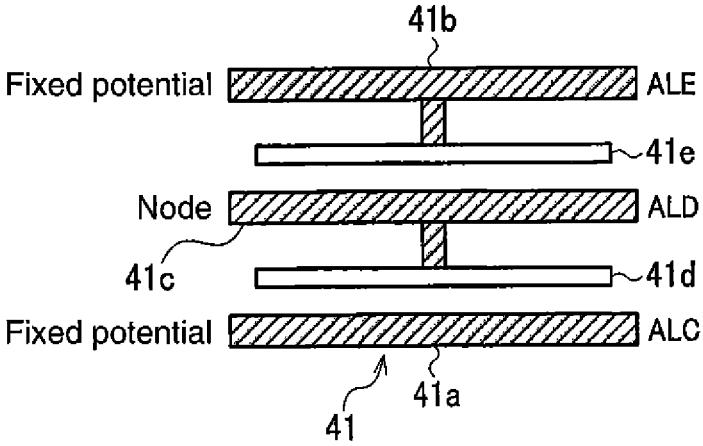

The first holding capacitors 44 and the second holding capacitors 41 in the blocks shown in FIG. 6 can be formed as shown in FIGS. 9A and 9B. In this embodiment, the first holding capacitor 44 has node electrodes 44*a* and 44*b* that are arranged on a third metal layer ALC and a fourth metal layer ALD, and an MIM plate electrode 44*c* that is formed therebetween as shown in FIG. 9A. The MIM plate electrode 44*c* is connected through a via-hole to the node electrode 44*b*. An MIM capacitor element is configured by the node electrode 44*a*, the MIM plate electrode 44*c*, and an insulating member therebetween. The second holding capacitor 41 has fixed potential electrodes 41*a* and 41*b* that are arranged on a third metal layer ALC and a fifth metal layer ALE, a node electrode 41*c* that is disposed on a fourth metal layer ALD, an MIM plate electrode 41*d* that is disposed between the electrodes 41*a* and 41*c*, and an MIM plate electrode 41*e* that is disposed between the electrodes 41*b* and 41*c*, as shown in FIG. 9B. The MIM plate electrode 41*d* is connected to the node electrode 41*c*, and the MIM plate electrode 41*e* is connected to the fixed potential electrode 41*b*. The second holding capacitor 41 is formed by stacking a capacitor element (the electrodes 41*a* and 41*c* and an insulating member therebetween) and a capacitor element (the electrodes 41*c* and 41*e* and an insulating member therebetween) in the height direction. Stacking in the height direction reduces the area occupied by the holding capacitors for ensuring a predetermined capacitance value, and, thus, the space can be saved.

As described above, the data lines 14A have a parasitic capacitance between the shield lines 80 arranged on both sides thereof and the MIM electrode in the upper layer. Since the holding capacitors are arranged in the column direction Y, the data lines 14 have different lengths for each of R, G, and B, and also have different parasitic capacitances. When the transfer gate 42 is turned ON and the voltage accumulated in the second holding capacitor 41 is released to the data line 14, the divided voltage of the data line may vary due to a difference in the parasitic capacitance. In order to adjust this variation, functions may be provided for changing the initialization potentials Vini and Vref or for changing the gradation correction for each of R, G, and B. The gradation correction has a function for changing a look-up table having a RAM and provided in the gamma correction portion 71 in FIG. 1 for each of R, G, and B.

4. Electronic Equipment

Figure 10:
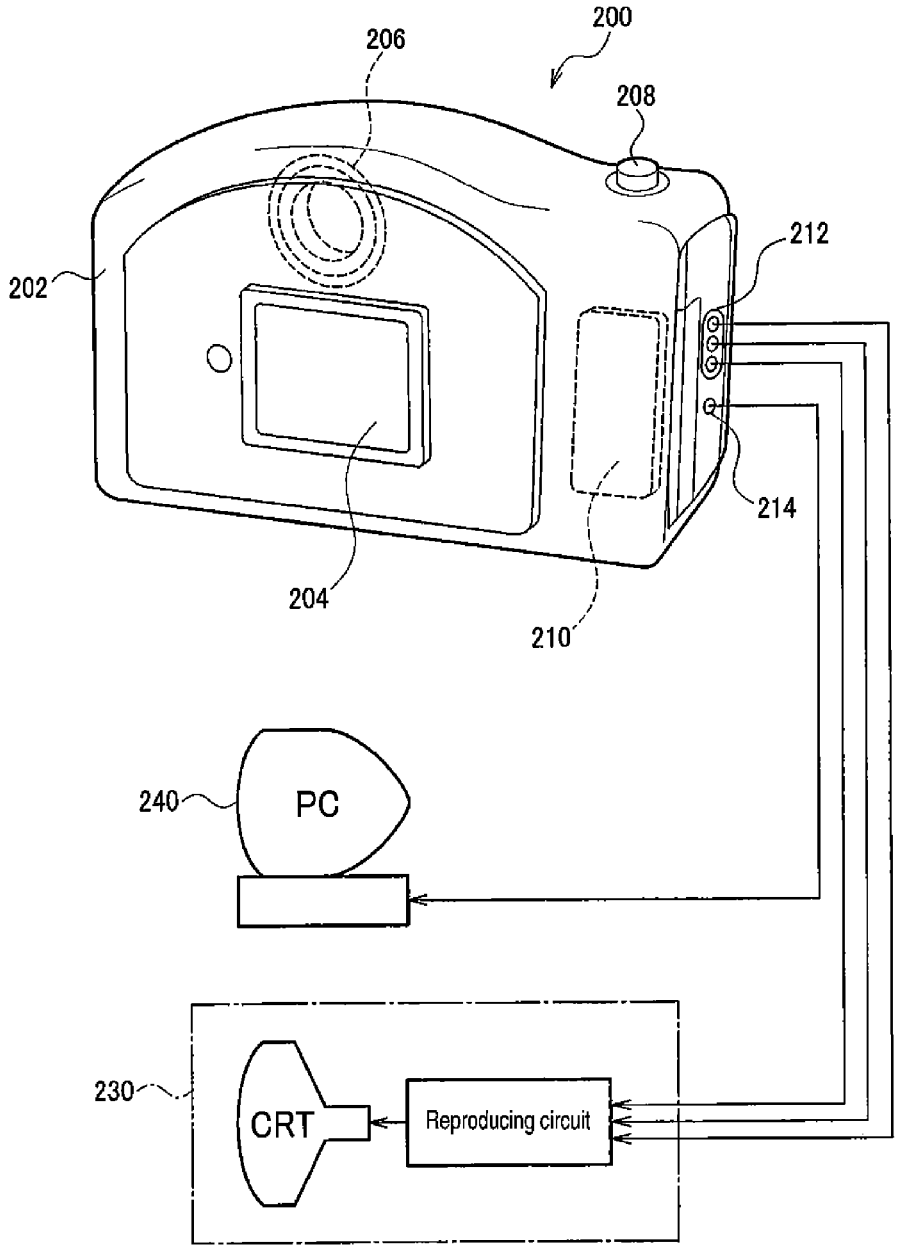
FIG. 10 is a view showing a digital still camera, which is an example of electronic equipment.

FIG. 10 is a perspective view showing the configuration of a digital still camera 200, wherein connection to external equipment is also schematically shown. A rear face of a casing 202 of the digital still camera 200 is provided with a display apparatus 204 employing the above-described display apparatus 10 using organic EL elements. The display apparatus 204 displays images based on imaging signals from a CCD (charge coupled device). Accordingly, the display apparatus 204 functions as an electronic viewfinder that displays a subject. The viewing side (the back face side in FIG. 10) of the casing 202 is provided with a light-receiving unit 206 including an optical lens, a CCD, and the like.

When the user views an image of the subject displayed on the display apparatus 204 and pushes a shutter button 208, the imaging signal of the CCD at that time is transferred and stored in a memory of a circuit board 210.

In the digital still camera 200, a side of the casing 202 is provided with video signal output terminals 212 and a data communication input/output terminal 214. A TV monitor 230 is connected to the video signal output terminals 212, and a personal computer 440 is connected to the data communication input/output terminal 214, as necessary. Furthermore, with a predetermined operation, the imaging signal stored in the memory of the circuit board 210 is output to the TV monitor 230 or the personal computer 240.

Figure 11:
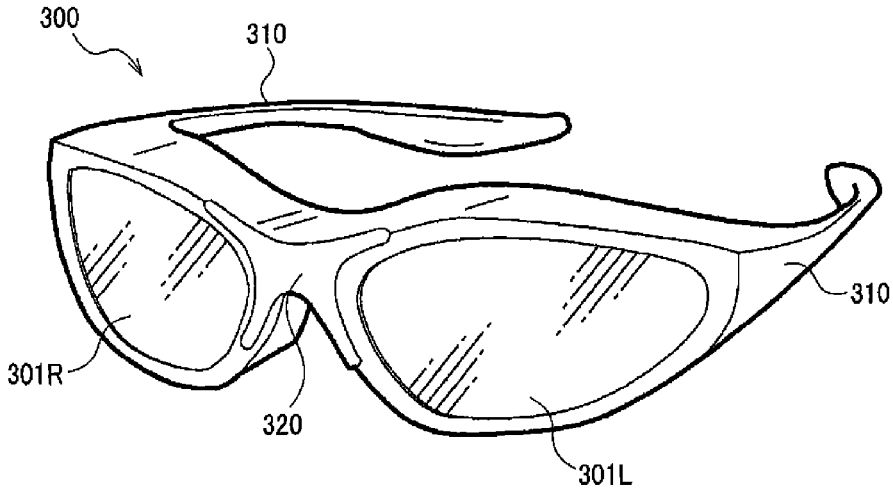
FIG. 11 is an external view of a head-mounted display, which is another example of electronic equipment.
Figure 12:
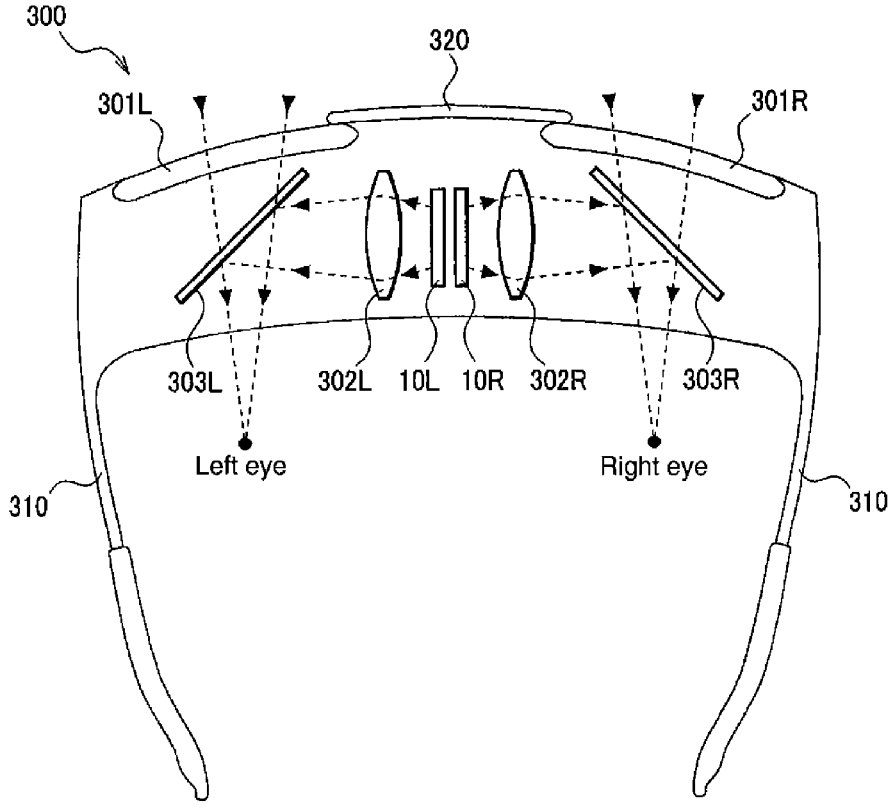
FIG. 12 is a view showing a display apparatus and an optical system of the head-mounted display.

FIGS. 11 and 12 show a head-mounted display 300. The head-mounted display 300 has temples 310, a bridge 320, and lenses 301L and 301R, as in the case of glasses. A display apparatus 10L for the left eye and a display apparatus 10R for the right eye are provided inside the bridge 320. The display apparatus 10 shown in FIG. 1 can be used as the display apparatuses 10L and 10R.

Images displayed on the display apparatuses 10L and 10R are transmitted via optical lenses 302L and 302R and half mirrors 303L and 303R and are incident on both eyes. An image for the left eye and an image for the right eye with parallax can realize 3D display. Note that the half mirrors 303L and 303R are light-transmissive, and, thus, they do not disturb the visual field of the user.

Although this embodiment has been described in detail, a person skilled in the art will easily understand that various modifications of the invention are possible without substantially departing from new matters and advantageous effects thereof. Accordingly, all of such modified examples are included in the scope of the invention. For example, terms that appear at least once in this specification or drawings can be replaced by different terms. Furthermore, the configurations and operations of the display apparatuses, the electronic equipment, and the like are not limited to those described in this embodiment, and various modifications are possible.

What is claimed is:

1. A display apparatus, comprising:

a plurality of pixel circuits that are arranged in a row direction in a display panel and respectively connected to a plurality of data lines extending in a column direction;

light-emitting elements that are respectively arranged in the plurality of pixel circuits;

first transistors that are respectively arranged in the plurality of pixel circuits, and supply driving currents to the light-emitting elements;

second transistors that are respectively arranged in the plurality of pixel circuits, and turn on and off connection between the data lines and the gates of the first transistors;

third transistors that are respectively arranged in the plurality of pixel circuits, and turn on and off connection between the gates and drains of the first transistors;

first holding capacitors that are respectively inserted and connected midway on the plurality of data lines, and shift levels of driving voltages of the first transistors; and holding capacitors that respectively hold potentials of the plurality of data lines;

wherein N first holding capacitors (N is a plural number) are arranged in the column direction, each of the first holding capacitors having an electrode width that is smaller than a width of N pixel circuits arranged adjacent to each other in the row direction, and that is equal to or larger than a width of one pixel circuit.

2. The display apparatus according to claim 1, wherein gradation voltages are simultaneously written to the N first holding capacitors via N data lines that are connected to the N first holding capacitors.

3. The display apparatus according to claim 2, wherein the gradation voltages simultaneously written are subpixel data signals forming one dot of a color display.

4. The display apparatus according to claim 2, wherein the N data lines are arranged in the lower layer of the N first holding capacitors.

5. The display apparatus according to claim 2, wherein shield lines having fixed potentials are arranged on both sides of each of the N data lines in the lower layer of the N first holding capacitors, when viewed from above.

6. The display apparatus according to claim 1, wherein a shield line having a fixed potential is disposed between two groups of the N first holding capacitors that are adjacent to each other in the row direction.

7. The display apparatus according to claim 1, further comprising:

second holding capacitors that are connected via transfer gates to the first holding capacitors;

wherein N second holding capacitors are arranged in the column direction, each of the second holding capacitors having an electrode width that is smaller than a total width of the N pixel circuits, and that is equal to or larger than a width of one pixel circuit.

8. The display apparatus according to claim 7, wherein initialization switches for supplying initialization potentials to both electrodes of the first holding capacitors, control signal lines for controlling the initialization switches, and buffers arranged midway on the control signal lines are arranged in the lower layer of the N second holding capacitors.

9. The display apparatus according to claim 8, wherein the buffers include a first stage buffer, a second stage buffer, and a third stage buffer, and the control signal lines include:

a first control signal line that extends in the row direction from the first stage buffer disposed on one side in the row direction to the lower layer of the N first holding capacitors;

a second control signal line that is connected via the second stage buffer to the first control signal line and extends from both ends in the row direction in the lower layer of the N first holding capacitors;

third control signal lines that extend in the column direction from the second control signal line outside the lower layer of the N first holding capacitors; and fourth control signal lines that extend in the row direction from the third control signal lines in the lower layer of the N first holding capacitors;

wherein the third stage buffer is connected to the fourth control signal lines.

10. The display apparatus according to claim 7, wherein the second holding capacitor is formed by stacking a plurality of capacitor elements in a height direction.

11. Electronic equipment comprising the display apparatus according to claim 1.

12. Electronic equipment comprising the display apparatus according to claim 2.

13. Electronic equipment comprising the display apparatus according to claim 3.

14. Electronic equipment comprising the display apparatus according to claim 4.

15. Electronic equipment comprising the display apparatus according to claim 5.

16. Electronic equipment comprising the display apparatus according to claim 6.

17. Electronic equipment comprising the display apparatus according to claim 7.

18. Electronic equipment comprising the display apparatus according to claim 8.

19. Electronic equipment comprising the display apparatus according to claim 9.

20. Electronic equipment comprising the display apparatus according to claim 10.

* * * * *